United States Patent [19]

Baumann

[11] 4,238,683

[45] Dec. 9, 1980

[54] X-RAY DIAGNOSTIC GENERATOR COMPRISING AN OIL-FILLED TANK WITH A HIGH VOLTAGE TRANSFORMER AND A HIGH VOLTAGE RECTIFIER, AND AN X-RAY TUBE

[75] Inventor: Heinz Baumann, Buckenhof, Fed. Rep. of Germany

[73] Assignee: Siemens Aktiengesellschaft, Berlin & Munich, Fed. Rep. of Germany

[21] Appl. No.: 23,901

[22] Filed: Mar. 26, 1979

[30] Foreign Application Priority Data

May 31, 1978 [DE] Fed. Rep. of Germany ..... 2823917

[51] Int. Cl.[3] ..... H05G 1/10

[52] U.S. Cl. ..... 250/421; 250/402; 250/418; 324/119

[58] Field of Search ..... 250/401, 402, 408, 418, 250/421; 324/119

[56] References Cited

U.S. PATENT DOCUMENTS

| | | | |
|---|---|---|---|
| 2,098,275 | 11/1937 | Cassen | 250/421 |
| 4,079,265 | 3/1978 | Woodburn | 250/402 |

*Primary Examiner*—Alfred E. Smith
*Assistant Examiner*—Thomas P. O'Hare
*Attorney, Agent, or Firm*—Hill, Van Santen, Steadman, Chiara & Simpson

[57] ABSTRACT

For the formation of an electric signal corresponding to the x-ray tube voltage, the high voltage transformer is provided with a low voltage winding. The low voltage at the terminals of the low voltage winding is conducted to the exterior of the tank. Here, a low voltage rectifier circuit is connected which corresponds in its circuit configuration to the high voltage rectifier circuit so that the electric signal supplied by the low voltage rectifier circuit accurately corresponds to the x-ray tube voltage and can be used for control purposes. The high voltage rectifier circuit and the low voltage rectifier circuit can operate as voltage multipliers.

2 Claims, 2 Drawing Figures

X-RAY DIAGNOSTIC GENERATOR COMPRISING AN OIL-FILLED TANK WITH A HIGH VOLTAGE TRANSFORMER AND A HIGH VOLTAGE RECTIFIER, AND AN X-RAY TUBE

BACKGROUND OF THE INVENTION

The invention relates to an x-ray diagnostic generator comprising an oil-filled tank in which a high voltage transformer, a high voltage rectifier, and an x-ray tube, connected thereto, are arranged, as well as comprising a circuit arrangement for the formation of an electric signal corresponding to the x-ray tube voltage.

For the formation of a signal corresponding to the x-ray tube voltage which signal e.g. can be introduced as the actual value signal into a control circuit for the x-ray tube voltage, it is known to connect, in parallel with the x-ray tube, a voltage divider and to tap this signal at a resistance of the voltage divider. In addition, it is known to derive this signal from the primary voltage connected to the high voltage transformer, or to tap said signal directly at a tap of the secondary winding of the high voltage transformer. In x-ray diagnosis, medium frequency generators are being utilized to an ever-increasing extent within the feed frequency of the high voltage transformer lies in the kHz-range; i.e. substantially above the mains frequency. In this manner, the high voltage transformer can be provided with a small and lightweight construction. In this instance, the direct tapping of the signal corresponding to the x-ray tube voltage in the primary or secondary circuit of the high voltage transformer does not lead to the required precision. The major reasons for this are the influences of the leakage inductance and stray capacitance as well as the load dependency in the case of utilization of a voltage multiplier circuit as the high voltage rectifier. The factors arguing against the installation of a voltage divider for the purpose of tapping the signal corresponding to the x-ray tube voltage are: the occurring power loss, the space requirement in the tank, the frequency spectrum of the high voltage output (on account of the medium frequency residual ripple, the voltage divider must be frequency-compensated by means of capacitors), as well as the comparatively high costs occurring on account of the requirement of utilizing high voltage precision resistances and high voltage capacitors.

SUMMARY OF THE INVENTION

The object underlying the invention consists in designing an x-ray diagnostic generator of the type initially cited such that, pursuant to supplying the high voltage transformer with medium frequency, the signal corresponding to the x-ray tube voltage can be obtained without additional elements being arranged in the tank, and that this signal has the necessary precision.

This object is achieved in accordance with the invention by virtue of the fact that the high voltage transformer is provided with a tap for a low voltage which is guided out from the tank and at which a rectifier with the same circuit configuration as the high voltage rectifier is connected outside the tank which rectifier supplies the electric signal corresponding to the x-ray tube voltage. In the inventive x-ray diagnostic generator, a low voltage is tapped at the high voltage transformer from which, by means of a rectifier circuit equivalent to the high voltage rectifier, the signal corresponding to the x-ray tube voltage is formed. No circuit elements whatsoever for obtaining this signal thus need be arranged in the tank, for these circuit elements can be low voltage-circuit elements. Since the circuit for the formation of this signal is a copy of the high voltage rectifier, and since the x-ray tube voltage circulates through it, this signal corresponds to the x-ray tube voltage with great precision.

The invention shall be explained in further detail in the following on the basis of an exemplary embodiment illustrated in the drawing; and other objects, features and advantages will be apparent from this detailed disclosure and from the appended claims.

DETAILED DESCRIPTION

Figure 1:
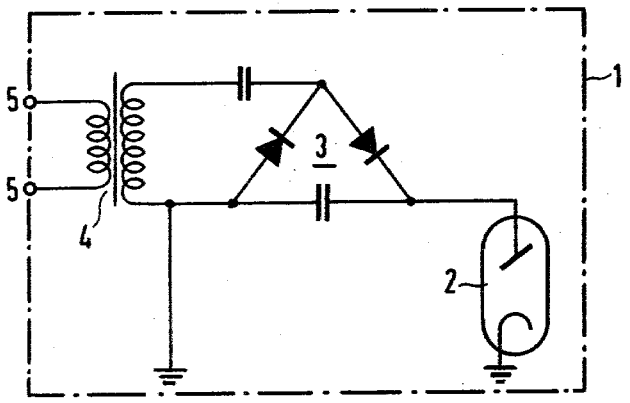
FIG. 1 illustrates an x-ray diagnostic generator comprising a voltage doubler-cascade in the high voltage circuit for the purpose of explaining the inventive idea.

In FIG. 1, an oil-filled tank is represented at 1 in which an x-ray tube 2, a high voltage rectifier 3, as well as a high voltage transformer 4, are arranged. The primary voltage is supplied to the high voltage transformer 4 via terminals 5. The high voltage rectifier 3 represents a voltage doubler-cascade; i.e., the peak voltage at x-ray tube 2 is, due to the charging of the capacitors of the high voltage rectifier 3, twice as great as the peak-output voltage of the high voltage transformer 4.

Figure 2:
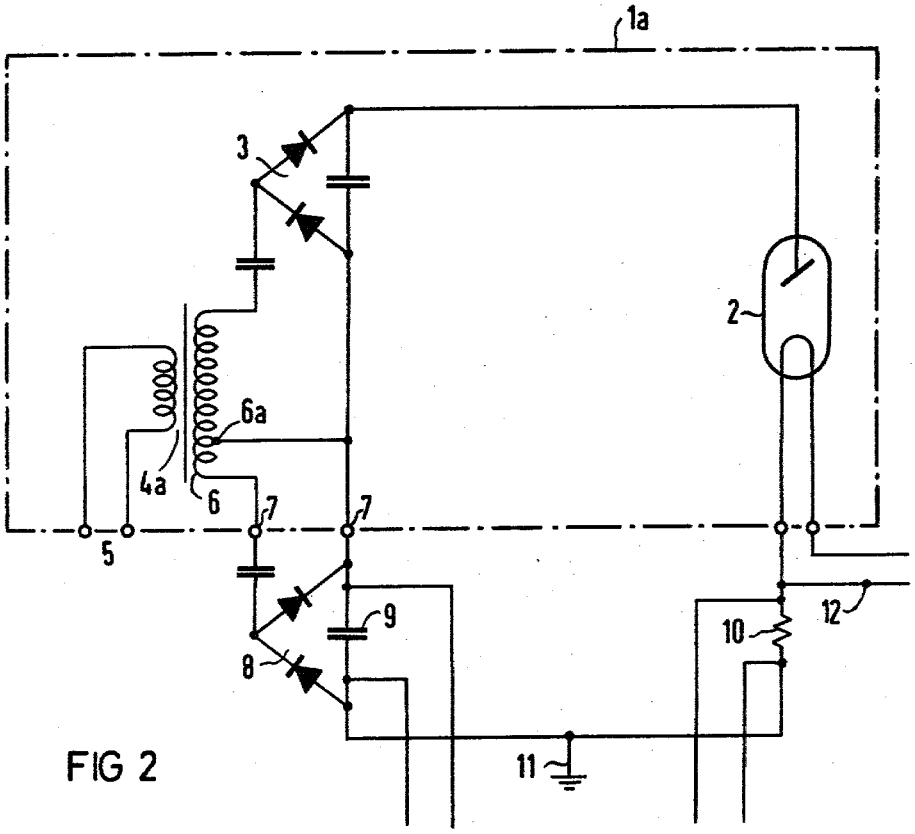
FIG. 2 illustrates an x-ray diagnostic generator in accordance with the invention.

In the sample embodiment according to FIG. 2, components which correspond to components according to FIG. 1, are referenced with the same reference numerals. From FIG. 2, it is apparent that the secondary winding of the high voltage transformer **4*a*, which, together with x-ray tube 2 and the high voltage rectifier 3, is arranged in tank 1*a*, manifests a low voltage part 6 with a tap 6*a*. The low voltage tapped there is conveyed to terminals 7 to which a low voltage-rectifier 8 is connected which, in terms of its circuit configuration, corresponds to the high voltage rectifier 3. At capacitor 9 of the low voltage rectifier 8**, an actual value signal corresponding to the x-ray tube voltage is tapped.

It is additionally apparent from FIG. 2 that the heating filament terminals of x-ray tube 2 are also guided out from tank **1*a*; i.e. the filament transformer is arranged outside tank 1*a*. The connecting line between the low voltage rectifier 8 and the cathode of the x-ray tube 2 outside the tank 1*a* is connected to ground either at point 11 (as actually shown) or at point 12 (in correspondence with FIG. 1). Disposed in the latter connection line is a resistance 10** at which a signal corresponding to the x-ray tube current is tapped.

It will be apparent that many modifications and variations may be effected without departing from the scope of the novel concepts and teachings of the present invention.

I claim as my invention:

1. An x-ray diagnostic generator comprising an oil-filled tank, a high voltage transformer, a high voltage rectifier circuit, and an x-ray tube arranged in said oil-filled tank, the high voltage rectifier circuit being connected for supplying an x-ray tube high voltage to said x-ray tube, and a circuit arrangement for the formation of a signal corresponding to the x-ray tube high voltage, characterized in that the high voltage transformer (**4*a*) is provided with a tap (6*a*) for supplying a low voltage which is conducted out from the tank (1***a*), and said circuit arrangement comprising a measuring rectifier circuit (8) outside said tank and connected for energization by the low voltage from said tap and having the same circuit configuration as the high voltage rectifier circuit (3) such that said measuring rectifier circuit supplies an electric signal corresponding to the x-ray tube high voltage.

2. An x-ray diagnostic generator according to claim 1, characterized in that the high voltage rectifier circuit (3) and the measuring rectifier circuit (8) are cascade circuits operated for increasing their output voltage in comparison to their input voltage.

* * * * *